US005407135A

United States Patent [19]

Jeffs

[11] Patent Number: 5,407,135

[45] Date of Patent: Apr. 18, 1995

[54] HAND-HELD AIR BLOWER DEVICE

[75] Inventor: Christopher S. Jeffs, Berkshire, United Kingdom

[73] Assignee: Imperial Chemical Industries PLC, London, England

[21] Appl. No.: 152,892

[22] Filed: Nov. 16, 1993

[51] Int. Cl.[6] ..... B05B 7/04; B05B 15/00

[52] U.S. Cl. ..... 239/288; 239/428.5; 239/434; 239/526; 239/DIG. 7

[58] Field of Search ..... 239/407, 428.5, 433, 239/434, 434.5, 526, DIG. 7, 153, 154, 288

[56] References Cited

U.S. PATENT DOCUMENTS

| | | | |
|---|---|---|---|
| 3,047,208 | 7/1962 | Coanda | 239/DIG. 7 X |
| 3,743,186 | 7/1973 | Mocarski | 239/433 X |
| 3,795,367 | 3/1974 | Mocarski | 239/DIG. 7 X |
| 3,801,020 | 4/1974 | Mocarski | 239/433 X |
| 3,806,039 | 4/1974 | Mocarski | 239/DIG. 7 X |
| 3,943,724 | 3/1976 | Mocarski | 239/434.5 X |
| 4,010,902 | 3/1977 | Speyer | 239/428.5 |
| 4,030,666 | 6/1977 | Gagliardo | 239/526 |
| 4,161,289 | 7/1979 | Rebold | 239/526 X |
| 4,867,380 | 9/1989 | Sibbertsen | 239/428.5 X |

*Primary Examiner*—Andres Kashnikow

*Assistant Examiner*—Lesley D. Morris

*Attorney, Agent, or Firm*—Cushman Darby & Cushman

[57] ABSTRACT

A hand-held air blower device for directing a jet of air in a desired direction, including a barrel having a longitudinal axis and having a low pressure air inlet at an upstream end for admitting air at atmospheric pressure and an outlet at an opposite downstream end for the jet of air, the barrel having a throat, intermediate its ends, whose inner wall has a convex contour, and the barrel having a narrow high pressure air inlet slot, with an upstream and a downstream side wall in relation to the direction of air flow through the barrel immediately adjacent the throat on the low pressure air inlet side of the throat. The convex contour of the inner wall of the throat, along the longitudinal axis of the barrel between its ends, is disposed at a small acute angle to the downstream side wall of the high pressure air inlet slot, and changes progressively downstream to being disposed at a small acute angle to the longitudinal axis. A handle is connected to the barrel. A source of high pressure air is connected to the blower device. A manually-operable valve controls the supply of the high pressure air from the high pressure air source to the high pressure air inlet slot.

14 Claims, 4 Drawing Sheets

HAND-HELD AIR BLOWER DEVICE

BACKGROUND OF THE INVENTION

1. Field of the Invention

This invention relates to a hand-held air blower device, and is particularly useful in accelerating the drying of intermediate and final coats of water-borne coatings for example during the re-painting of road vehicles, as described in my U.S. patent application Ser. No. 08/055,012, which is hereby incorporated by reference. As explained in the above identified Patent Application, the use of water-borne paints instead of solvent-based paints for vehicle re-spraying has overcome environmental and other problems, but has introduced the problem of removing water from the paint once it has been sprayed. Blowing air at water-based coatings tends to cause the formation of a skin on the outer surface which then severely limits the proper loss of water from within the film. This has adverse consequences on the appearance of film, since shrinkage of the film can be uneven and flake control in metallic or mica flake containing films deteriorates. A further disadvantage of air blowing systems has been the disturbance of dust from adjacent surfaces, which contaminates the coating.

2. Description of the Prior Art

Heating vehicles in a hot air blown kiln to cure the base coating is of course a conventional process, as disclosed for example in FR-A-2029314, where high temperatures such as 200° C. are proposed. Indeed, infrared radiative heating has been proposed for accelerating secondary coatings preparatory to a top coating. Heating in this way is not only expensive for a motor vehicle re-spray process but is also of course impractical for an assembled vehicle which would be damaged by the heat.

In the Patent Application referred to above, I disclose as my invention the method of forcing evaporation of solvent such as water from a coating on a predefined surface of a panel by directing a jet of air from an air supply held at a predetermined distance from the panel towards one edge region of the panel, the jet being substantially narrower, when it reaches the panel edge region than the length of the panel edge and the jet being inclined to the plane of the panel such that the air from the jet is entrained by the panel in a spreading, predominantly laminar flow across the panel surface over that edge region and from that edge region to all the other edges thereof, thereby inducing such laminar flow over substantially the whole surface and replacing vapor-laden air closely adjacent the surface with fresh air to accelerate drying. The use of an essentially local air supply allows the position and direction of the air jet to be controlled so as to optimize the drying effect of the air, and so as to avoid disturbing any dust which may be present on adjacent surfaces. While the flow velocity of the air jet may be 1–2 m/sec. as it reaches and travels along the panel surface, there is no need to increase the usual flow rate of drying air which may be moving in bulk elsewhere, e.g. from ceiling to floor in a booth. This also avoids dust disturbance. This method is particularly energy efficient and it is surprisingly effective in drying panels such as vehicle doors and bonnets.

The preferred form of air supply is one which supplies a jet of air at a flow velocity substantially greater than any external air flow, such as the bulk movement of air from the ceiling to the floor of a paint booth. The preferred form of air supplier is of the "air mover" type, which uses a source of high-pressure air to entrain atmospheric air taken from the exterior, so that the air mover provides an outlet jet which is a combination of air from the high pressure source and air from the exterior. The principle of using a jet of high pressure air to entrain the flow of lower pressure air is known for example from U.S. Pat. No. 3,942,724 (Mocarski) which discloses a nozzle with high and low pressure air inlets.

SUMMARY OF THE INVENTION

It is an object of the present invention to provide greater flexibility in the position and direction of the air jet for drying vehicle panels and the like.

It is a further object of the present invention to overcome the problems identified above in the drying of water-borne base coats.

Accordingly, the invention provides a hand-held air blower device for directing a jet of air in a desired direction, comprising: a barrel having a longitudinal axis between an upstream end and a downstream end thereof, the barrel having a low pressure air inlet at the upstream end for admitting air at atmospheric pressure and an outlet at the downstream end for the jet of air, and the barrel having a high pressure air inlet for injecting high pressure air into the barrel at a region intermediate its ends; a handle connected to the barrel for holding the air blower device; and means for connecting a source of high pressure air to the blower device.

The blower device is hand-held and accordingly is capable of being readily re-directed and re-positioned by the operator.

Preferably, the high pressure air inlet is a slot extending generally transverse to the longitudinal axis. Also, it is preferred that the slot has an upstream and a downstream side wall, in relation to the longitudinal direction of air flow through the barrel; and the barrel has an inner surface whose narrowest portion is a throat intermediate its said ends, downstream of the slot and immediately adjacent the downstream side wall thereof.

Preferably, the throat has a convex contour when viewed from within the barrel, the surface of the throat being at a small acute angle to the downstream side wall of the high pressure air inlet slot and changing progressively downstream to being at a small acute angle to the longitudinal axis.

In the preferred embodiment, the device has manually-operable valve means for controlling the supply of the high pressure air from the connecting means to the high pressure air inlet slot.

The convex contour of the throat wall gives rise to the Coanda effect on the high pressure air emerging from the inlet slot. Thus the high pressure air preferentially follows the contour of the wall, instead of continuing in its original direction towards the central axis of the blower device. In so doing, the high pressure air entrains low pressure air from the center of the throat, lowering the pressure of air upstream, and drawing in bulk air from the exterior at atmospheric pressure. In turn, this gives rise to the required jet of air along the longitudinal axis from the outlet. The outlet flow rate is the sum of the flow rates of the inlet atmospheric air and the inlet high pressure air.

BRIEF DESCRIPTION OF THE DRAWINGS

In order that the invention may be better understood, a preferred embodiment will now be described, by way of example only, with reference to the accompanying drawings, in which.

DESCRIPTION OF THE PREFERRED EMBODIMENT

Figures 1, 1A:
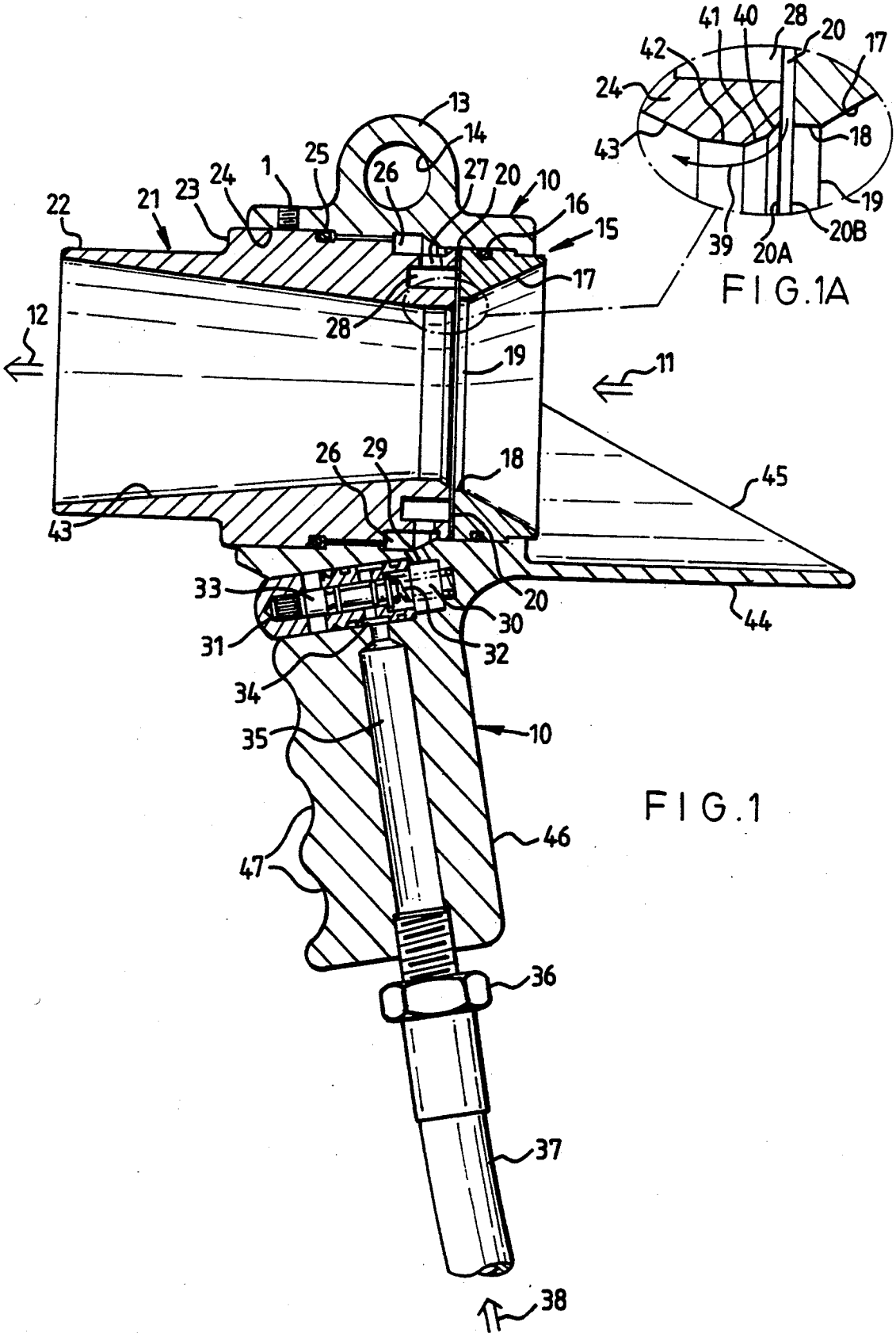
FIG. 1 is a longitudinal section through a hand-held air blower device embodying the invention.
FIG. 1A is an enlarged partial view of the throat of the barrel of the device of FIG. 1.
Figure 2:
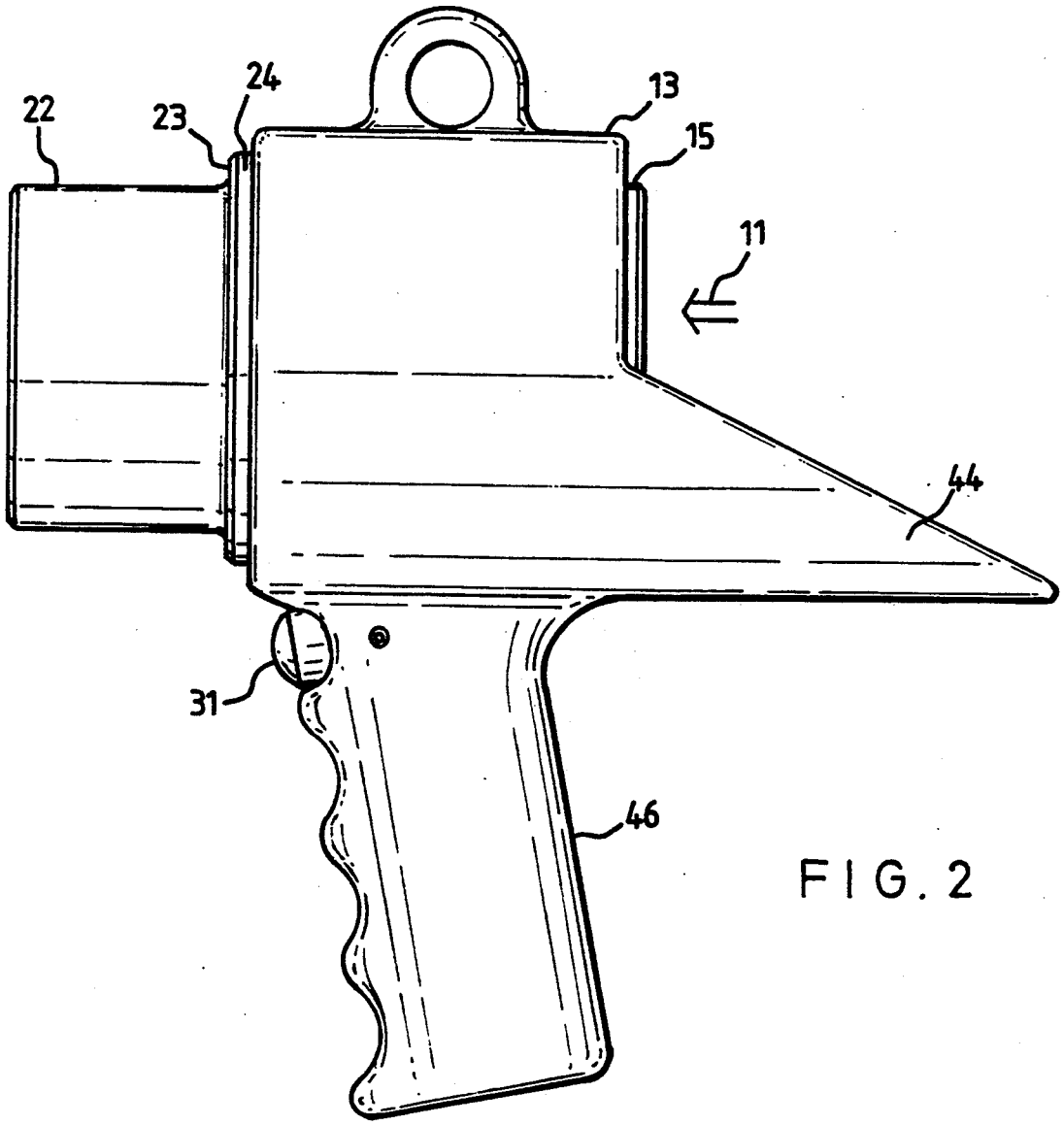
FIGS. 2 to 6 respectively are a side view, a top plan view, an underneath plan view, a front end view and a rear end view of the device of FIG. 1.
Figure 3:
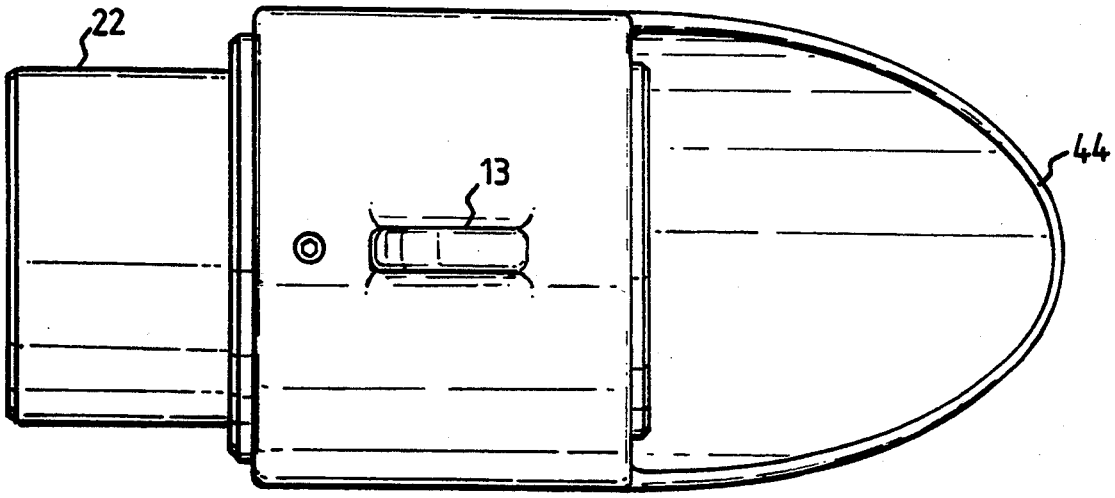
Figure 4:
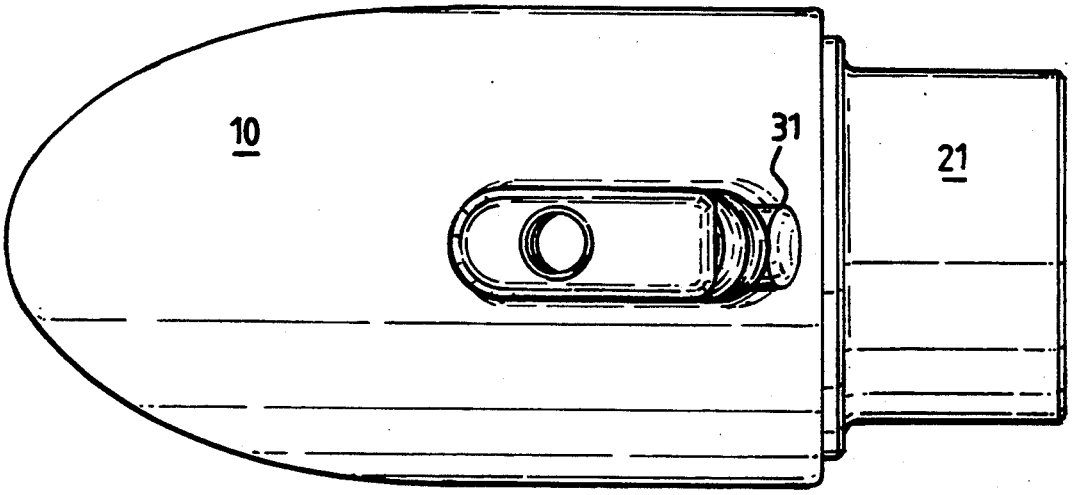
Figure 5:
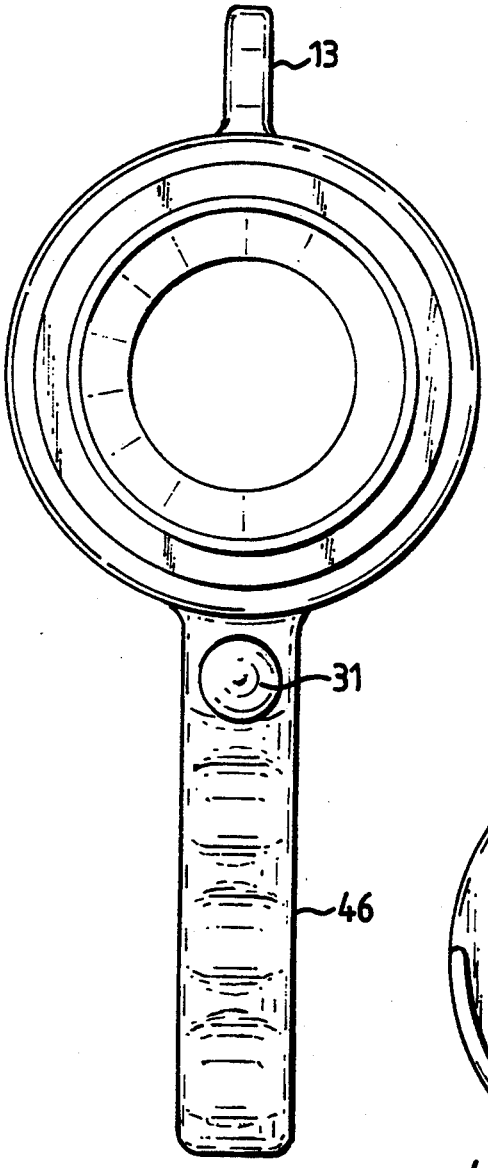
Figure 6:
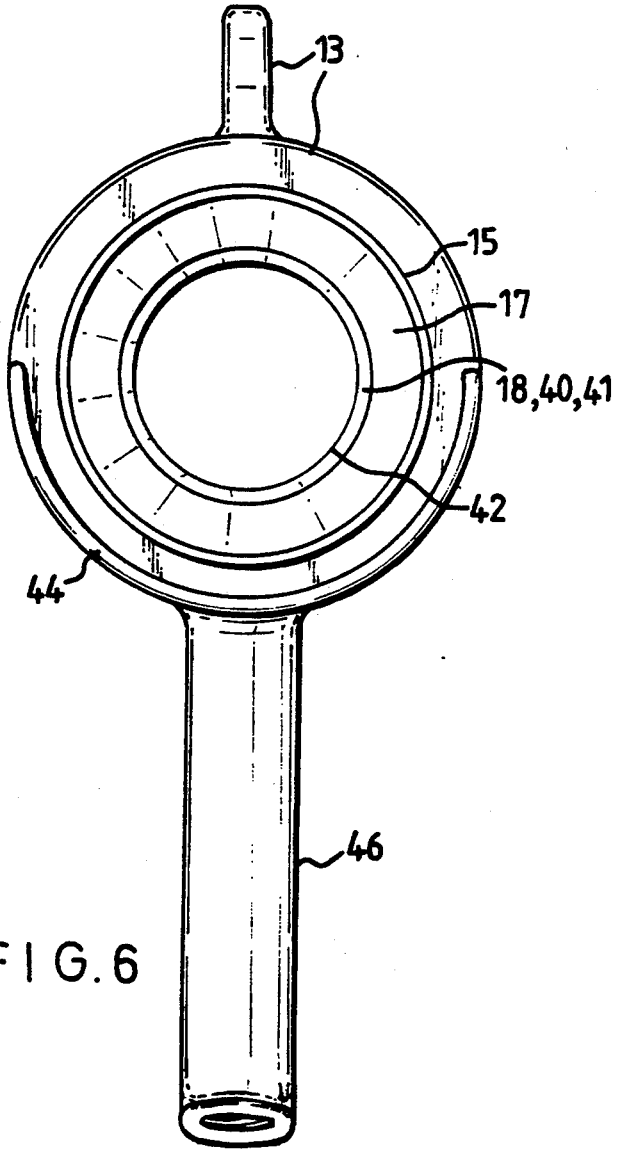

The hand-held air blower device of FIGS. 1 to 6 consists of two interconnected body components: a handle 10 and a barrel 21. The barrel 21 has a generally cylindrical outer wall which is accommodated with a sliding fit by a cylindrical opening in the handle 10. Once assembled, they are firmly connected together by a screw 1. The handle 10 has a pistol grip portion 46 with indentations 47 for receiving the fingers of the operator, and a push button 31 for operating a high pressure air inlet valve 30, 32, 33 to be described below. The pistol grip portion depends generally at 90° from a longitudinal axis of the barrel 21, so that the entire device resembles a pistol.

A sleeve guard 44 with a part-cylindrical wall 45 depends longitudinally from a low pressure air inlet end 15 of the barrel, adjacent the pistol grip portion 46. The guard 44 is shown in FIGS. 1, 2, 3 and 6, and is in the form of a truncated half cylinder. It serves to prevent the ingress of dust and dirt from the operator's clothing, and also to stabilize the grip of the device.

An upper portion 13 of the handle 10 consists of an upwardly projecting apertured lug for hanging the device on a hook or the like. In this example, the aperture 14 is cylindrical.

The barrel 21 is intended to receive external air 11 at atmospheric pressure, to pass this through a throat portion of the barrel, to accelerate this air flow, and to provide an outlet jet 12 along the longitudinal axis of the barrel. The throat of the barrel is shown more clearly in the enlarged view of FIG. 1A. The upstream portion of the barrel has a cylindrical outer surface 15, stepped with a shoulder to engage a corresponding shoulder of the inner surface of the handle 10. This surface also has an annular recess with an O-ring seal 16 for providing an airtight seal against the handle 10. The inner surface of this upstream portion is a conical surface 17 tapering inwardly towards the throat. The conical surface 17 terminates at a narrow cylindrical inner surface 18, which then terminates at the outlet edge of the upstream wall 20B of a high pressure air inlet slot 20. The slot 20 is, in this example, a shim of 1/2000th inch width, although a possible range would be from 1/1000th to 1/6000th inch.

The throat portion 40 to 43 of the barrel begins at surface 40 which is at a small acute angle, typically 30°, to the downstream wall 20A of the high pressure air inlet slot 20. The next adjacent facet 41 of the throat wall is at an angle rather closer to the longitudinal axis, for example at 45°. The next adjacent facet 42 of the throat, rather wider than facets 40 and 41, is generally parallel to the longitudinal direction, and terminates at a wall 43 of the downstream portion of the barrel 10. This inner wall 43 of the downstream portion of the barrel is conical, at a small acute angle such as 15° to the longitudinal axis, tapering inwardly towards the throat.

The external wall of the barrel downstream of the inlet slot 20 is also generally cylindrical. An outlet end 22 is perfectly cylindrical, and this is enlarged at a shoulder 23 at the point where the barrel reaches the downstream end of the handle portion 10. Shoulder 23 links the cylindrical surface 22 with a wider cylindrical surface 24, which is formed with an annular recess having an O-ring seal 25 forming an airtight seal against the inner surface of the handle 10.

An annular chamber 28 in the barrel, at the same longitudinal position as the throat, communicates with the inlet slot 20, as shown in FIGS. 1 and 1A. This chamber 28 in turn communicates by way of a plurality of throttles 27 in the radial direction, with an annular chamber 26 formed as a recess around the outer wall of the barrel 10.

The outer chamber 26 is in register with a high pressure air supply port 29 formed at the outlet of the valve assembly 30, 32, 33. The valve assembly consists of a spool 33 biased outwardly, in the left-hand direction of FIG. 1, by a coil spring 32, within a airtight chamber 30. The spool is reciprocally moveable by the valve knob 31, which projects from the pistol grip in the manner of a trigger. The spool 33 has an annular recess 34 which is brought into register with a high pressure air inlet channel 35, only when the knob 31 is depressed, as illustrated in FIG. 1. In this depressed position, high pressure air 38 conveyed along flexible hose 37 and union 36 to the channel 35 within the handle 10, reaches the inner chamber 30. From the inner chamber 30, the high pressure air emerges through channel 29 to the barrel chambers 26 and 28, where it then emerges through the inlet slot 20. When the push button 31 is released and the spool 33 shifts under spring action 32 towards the left in FIG. 1, the valve is closed, with the recess 34 no longer in register with the channel 35.

In this way, the operator can switch on or off the supply of high pressure air to the inlet slot 20. Using his or her skill and experience, the operator can expose the paint to just the right duration of air blowing.

As the high pressure air emerges from the inlet 20 at right angles to the longitudinal axis of the barrel 21, it is drawn by the Coanda effect progressively in the downstream direction, as shown by arrow 39 in FIG. 1A. It is attracted to the progressively stepped surfaces 40, 41, 42 and 43 of the inlet wall of the barrel. It is not drawn to the upstream surface 18, because that is parallel to the longitudinal axis. The high speed flow of this high pressure air 39 creates a region of low pressure which attracts bulk air flow 11 in the longitudinal direction. This bulk air flow combines with the high pressure air flow, within the barrel 21, and the combined air flow is at an intermediate velocity when it emerges at 12.

In this example, the diameter of the air outlet is 56 mm, the minimum diameter of the throat is 40 mm, and the diameter of the low pressure air inlet at 15 is 63 mm. Also in this example, the barrel and handle bodies are both formed of aluminum.

The flow rate performance of this particular device is shown in the table below in which "psig" means the pressure of the high pressure air supplied at 38, "input volume" is the flow rate of air at high pressure from the high pressure source, measured in cu.ft./min., "output volume" is the rate of flow of air at intermediate pressure from the outlet 22, measured in cu.ft./min., and "ratio output/input" is the ratio of the output to the input volumetric flow rates.

TABLE 1

| psig | input volume cu.ft./min. | output volume cu.ft./min. | ratio input/output |
|---|---|---|---|
| 25 | 3.66 | 62.5 | 17.0 |
| 30 | 4.25 | 70.9 | 16.7 |
| 35 | 4.67 | 74.1 | 15.9 |
| 40 | 5.26 | 86.8 | 16.4 |
| 45 | 5.94 | 93.2 | 15.7 |

In use, the operator holds the device as he or she would a pistol, directs the outlet air flow in the desired direction over a surface to be dried, and at an appropriate distance from that surface, and depresses the button 31 to supply a jet of air for one or more periods, until he or she judges that the drying is complete.

Although the invention has been illustrated by one particular embodiment, it should be understood that the device could take alternative forms, while still having the essential features of the invention as defined in the claims.

What is claimed is:

1. A hand-held air blower device for directing a jet of air in a desired direction, comprising:

a barrel having a longitudinal axis between an upstream end and a downstream end thereof, the barrel having a low pressure air inlet at the upstream end for admitting air at atmospheric pressure and an outlet at the downstream end for the jet of air, and the barrel having a high pressure air inlet for injecting high pressure air into the barrel at a region intermediate its said ends;

a handle connected to the barrel for holding the air blower device;

means for connecting a source of high pressure air to the blower device; and a solid guard wall projecting longitudinally from part of the edge of the low pressure air inlet and adjacent the handle.

2. A device according to claim 1, in which the high pressure air inlet is a slot extending generally transverse to the longitudinal axis.

3. A device according to claim 2, in which the slot has an upstream and a downstream side wall, in relation to the longitudinal direction of air flow through the barrel; and the barrel has an inner surface whose narrowest portion is a throat intermediate its said ends, downstream of the slot and immediately adjacent the said downstream side wall thereof.

4. A device according to claim 3, in which the throat has a convex contour when viewed from within the barrel, the surface of the throat being at a small acute angle to the downstream side wall of the high pressure air inlet slot and changing progressively downstream to being at a small acute angle to the longitudinal axis.

5. A device according to claim 1, comprising manually-operable valve means for controlling the supply of the high pressure air from the connecting means to the high pressure air inlet slot.

6. A device according to claim 3, in which the downstream side wall of the high pressure air inlet slot is at substantially 90° to the longitudinal axis.

7. A device according to claim 3, in which the barrel is generally cylindrical and the surfaces of the throat and of the high pressure air inlet slot are generally annular.

8. A device according to claim 3, in which the inner wall of the barrel between the throat and the low pressure air inlet is generally conical, tapering inwardly towards the throat.

9. A device according to claim 3, in which the inner wall of the barrel between the throat and the air outlet is generally conical, tapering inwardly towards the throat.

10. A device according to claim 1, in which the handle is in the form of a pistol-grip body depending at substantially 90° from the barrel.

11. A device according to claim 5, in which the manually-operable valve means and the means for connecting a source of high pressure air are located on the handle, and the handle includes a channel interconnecting the source of high pressure air and the valve means, the channel being arranged for communicating with the high pressure air inlet slot of the barrel.

12. A device according to claim 5, in which the handle is in the form of a pistol-grip body depending at substantially 90° from the barrel.

13. A device according to claim 12, in which the valve means includes a push button operable as a trigger in the pistol-grip body.

14. A method of directing a jet of air in a desired direction using a hand-held air blower device which includes:

a barrel having a longitudinal axis between an upstream end and a downstream end thereof, the barrel having a low pressure air inlet at the upstream end for admitting air at atmospheric pressure and an outlet at the downstream end for the jet of air, and the barrel having a high pressure air inlet for injecting high pressure air into the barrel at a region intermediate its said ends;

a handle connected to the barrel for holding the air blower device;

means for connecting a source of high pressure air to the blower device; and a solid guard wall projecting longitudinally from part of the edge of the low pressure air inlet and adjacent the handle, said method comprising:

disposing said hand-held air blower device with its longitudinal axis pointing in the desired direction, supplying high pressure air at between 20 and 45 psig to the high pressure air inlet, and opening the valve means.

* * * * *